US008752650B2

(12) United States Patent
Gray

(10) Patent No.: US 8,752,650 B2
(45) Date of Patent: Jun. 17, 2014

(54) THROUGH THE DRILL STRING OR CORE BIT DST SYSTEM

(76) Inventor: Ian Gray, Queensland (AU)

( * ) Notice: Subject to any disclaimer, the term of this patent is extended or adjusted under 35 U.S.C. 154(b) by 0 days.

(21) Appl. No.: 13/701,688

(22) PCT Filed: Jun. 3, 2011

(86) PCT No.: PCT/AU2011/000693

§ 371 (c)(1),
(2), (4) Date: Dec. 7, 2012

(87) PCT Pub. No.: WO2011/150465

PCT Pub. Date: Dec. 8, 2011

(65) Prior Publication Data

US 2013/0068528 A1 Mar. 21, 2013

(30) Foreign Application Priority Data

Jun. 4, 2010 (AU) ..... 2010902496

(51) Int. Cl.
*E21B 7/00* (2006.01)

(52) U.S. Cl.
USPC ..... 175/57; 175/239; 175/245; 175/249; 166/179

(58) Field of Classification Search
USPC ..... 175/40, 57, 239, 245, 332, 387, 403; 166/179
See application file for complete search history.

(56) References Cited

U.S. PATENT DOCUMENTS

| | | | | | |
|---|---|---|---|---|---|
| 3,032,116 | A | * | 5/1962 | Adelbert | 166/186 |
| 3,107,729 | A | * | 10/1963 | Adelbert et al. | 166/66 |
| 3,134,441 | A | * | 5/1964 | Adelbert et al. | 277/333 |
| 3,876,000 | A | | 4/1975 | Nutter | |
| 4,105,069 | A | | 8/1978 | Baker | |
| 5,799,733 | A | | 9/1998 | Ringgenberg et al. | |
| 5,864,057 | A | | 1/1999 | Baird | |

FOREIGN PATENT DOCUMENTS

| | | |
|---|---|---|
| CA | 2485840 | 2/1997 |

* cited by examiner

*Primary Examiner* — Yong-Suk (Philip) Ro
(74) *Attorney, Agent, or Firm* — Roger N. Chauza, PC

(57) ABSTRACT

Drill stern test apparatus includes a drill string, wireline coring system and a downhole tool that is seated in the core barrel of the coring system. A valve packer within the downhole tool is inflated to seal the core barrel and allow a valve to be operated by movement of the drill string. One or more packers can be inflated to isolate the test zone in the borehole below the coring system. The apparatus is operated to allow the test zone fluid to flow upwardly in the downhole tool and be measured. Downhole tool transducers accumulate the data and transmit the same to the surface. The wireline can be pulled to relieve packer inflation pressure, release a latch and allow the downhole tool to be pulled to the surface while leaving the coring system in place.

19 Claims, 6 Drawing Sheets

THROUGH THE DRILL STRING OR CORE BIT DST SYSTEM

PRIORITY CLAIM

This PCT international patent application claims priority to pending Australian provisional patent application serial number 2010902496, filed 4 Jun. 2010.

BACKGROUND OF THE INVENTION

Drill stem testing (herein referred to as DST) is a common feature in the exploration for oil or gas. When analysed correctly, the test may be used for the calculation of permeability and reservoir pressure. In its traditional form, DST involves fining a valve and an expandable packer below the drill string which is then run into a borehole with the drill string empty. A packer is traditionally set to seal the borehole by applying compression to it via an extension which rests on the borehole base. A valve is opened by rotating the drill string so that fluid from the formation below the packer flows through the packer and the valve into the drill stem. After a flow period, the valve is closed by further rotation of the drill string. The pressure in the borehole may then build up. The downhole pressure is usually recorded by a memory gauge, or the like. Flow may be recorded at the surface or by a second memory gauge which records fluid level changes within the drill pipe.

In more advanced forms, DST can use a straddle packer arrangement to seal the borehole above and below a test zone. In this case, the packers used are usually inflatable units which are inflated by a downhole pump. This may be activated by drill string rotation or by electrical means. Some tools use a form of radio telemetry to transmit information to the surface concerning pressures measured during the test.

Some tools also exist which are specifically designed to undertake injection rather than production, as in DST. Some of these may be run on the end of a drill string and are normally inflated by pressurising the drill string before opening a valve to inject fluid into the formation. Some variants of these toots may be used in conjunction with wireline coring systems. In this case, the tool is generally lowered through the drill string to seat in place of the inner core barrel, but with packer(s) protruding through the end of the core barrel so as to seal against the borehole.

DISCLOSURE OF INVENTION

According to the principles and concepts of the invention, DST is permitted in combination with typical wireline coring equipment, particularly that developed by Boart Longyear, which incorporates a drill string through which an inner tube of the core barrel and latch body assembly arc retrieved. Various embodiments of the invention permit testing of a zone below a single packer and the base of the hole, or of a zone straddled between packets.

In either case, drilling of the test zone is completed and the inner tube and core is retrieved. The drill string is then raised so that the end of the core bit is located at a suitable distance above the test zone. The tool is then lowered on a wireline through the drill string to seat within the outer core barrel. The wireline may be that used to lower the inner tube, or it may be a separate cable. In the former case, the wireline has attached to it a communications cable and an inflation tube. In the latter case the wireline would normally be a geophysical cable incorporating conductors for communication with the tool. An inflation tube would still be run in either case.

The tool, according to one embodiment, comprises one or two packers which protrude below the core barrel, depending on whether a test is to be conducted between a single packer and the bottom of the hole, or to be conducted in a zone straddled between packers. Within the core barrel there is another packer which serves as a valve controlling the movement of fluid within the annulus between the tool and the outer core barrel. Also included in the assembly within the outer core barrel is a main valve to control fluid flow through the DST tool, pressure transducers and electronics to record and transmit to the surface information on pressures within the test zone, preferably a system to latch the tool into place within the outer core barrel, and a dump valve to deflate the packers into the drill string.

Once the tool is run into position and latched into the outer core barrel, a top seal is placed around the wireline, cable and inflation line. The drill string is then pressurised with a gas to drive the well bore fluid down around the tool and the valve packer and thence into the borehole. This causes the well bore fluid to rise in the annulus and be discharged at surface.

When the fluid level has been lowered to a level suitable for testing, the two or three packers are inflated to seal the test zone and to seal between the tool and the outer portion of the core barrel. The packer inflation can be achieved by the use of high pressure gas supplied to the packers, in which case deflation is achieved later by releasing the pressurised gas at the surface. Preferably, however, packer inflation is achieved by pumping a liquid through the inflation line. Using a liquid of roughly similar density to the drilling fluid permits a minimal pressure to be applied to the inflation tube at the surface. In the case of liquid being used for inflation, deflation may be partially achieved by permitting the inflation tube to discharge at the surface. This will not generally be adequate to ensure expeditious or complete packer deflation, and therefore in a preferred embodiment, a dump valve is incorporated into the downhole tool which opens the bottom of the inflation tube and permits the packers to deflate to the inside of the drill string. The dump valve is opened by pulling on the wireline which is generally left slack during a test.

Pulling on the wireline also serves to unlatch the latching mechanism which is used in the preferred embodiment of the invention to hold the tool in place in the core barrel. The latching mechanism is designed to match up with the latching system used to hold the inner barrel of the core barrel in place. The system may operate without a latching mechanism, but in the event of the packers becoming suddenly deflated, there is a risk that the tool will be ejected upwards through the core barrel.

After packer inflation has been achieved, the main valve between the test zone and the inside of the drill string is closed. In a preferred embodiment of the invention, the main valve is normally held into the closed position until it is deliberately opened. This may be achieved by the use of a spring, vacuum chamber or other such device within the tool.

The gas in the drill string is then released at surface to leave part of the drill string empty of liquid and the remainder filled with gas, usually at atmospheric pressure. After the test zone pressure has stabilised, the main valve is opened to permit fluid flow from the test zone to pass through it into the drill string.

In a preferred embodiment of the invention, the main valve is a device which is opened by raising the drill string, and is closed by the reverse action. The main valve is also preferably a device which produces zero volume change in the test zone on closure so as not to pressurise the formation. It should also be pressure balanced so that changes in test zone pressure do not tend to open or close the valve.

Following the flow period the main valve is closed, preferably by lowering the drill string, and a pressure build up period is permitted to take place. During this period the pressure in the test zone is permitted to approach the reservoir pressure.

The entire test process is commonly repeated with another flow and build up period. During the flow periods the liquid flow rate may be determined by examining the change in pressure head within the drill string, as measured by a pressure transducer. Any gas flow is detected by a gas flow meter at the surface. To determine the net gas flow from the geological formation being tested, the liquid volume which has entered the drill string is subtracted from the gas displaced from the drill string.

It is also possible to use the tool to inject material into the formation (normally using liquid). In this case, the drill string is filled with fluid to be injected and the main valve is opened to permit injection. If the injection process is being used to determine formation properties, then following the injection period the main valve would be shut in and the tool left in place while the test zone pressures are permitted to stabilise.

At the end of the stabilisation period, either following an inflow or injection period, and with the drill string filled, the main valve is then opened to enable pressure to come to equilibrium between the test zone and the drill string. Following this process the packers are deflated.

Either before or after the tool is deflated, the top seal is removed. The tool may then be pulled out of the core barrel and through the drill string to surface. Once the tool and cables are on the surface, the drill string may be raised to test another zone, or used to drill the borehole to another depth. Typically, the tool is used in the straddle mode when the borehole drilling is completed before testing, but can be used in the bottom test mode when testing is conducted before the borehole is completed.

If the test zone packers cannot be withdrawn through the drill string due to packer failure or some other cause, then the apparatus is configured so that the wireline, inflation tube and cable may be pulled away from the top of the tool and recovered. The drill string may then be pulled and the tool recovered with it.

BRIEF DESCRIPTION OF DRAWINGS

Further features and advantages will become apparent from the following description of the drawings, in which like reference characters generally refer to the same parts, elements or functions throughout the views.

BEST MODE FOR CARRYING OUT THE INVENTION

Figure 1:
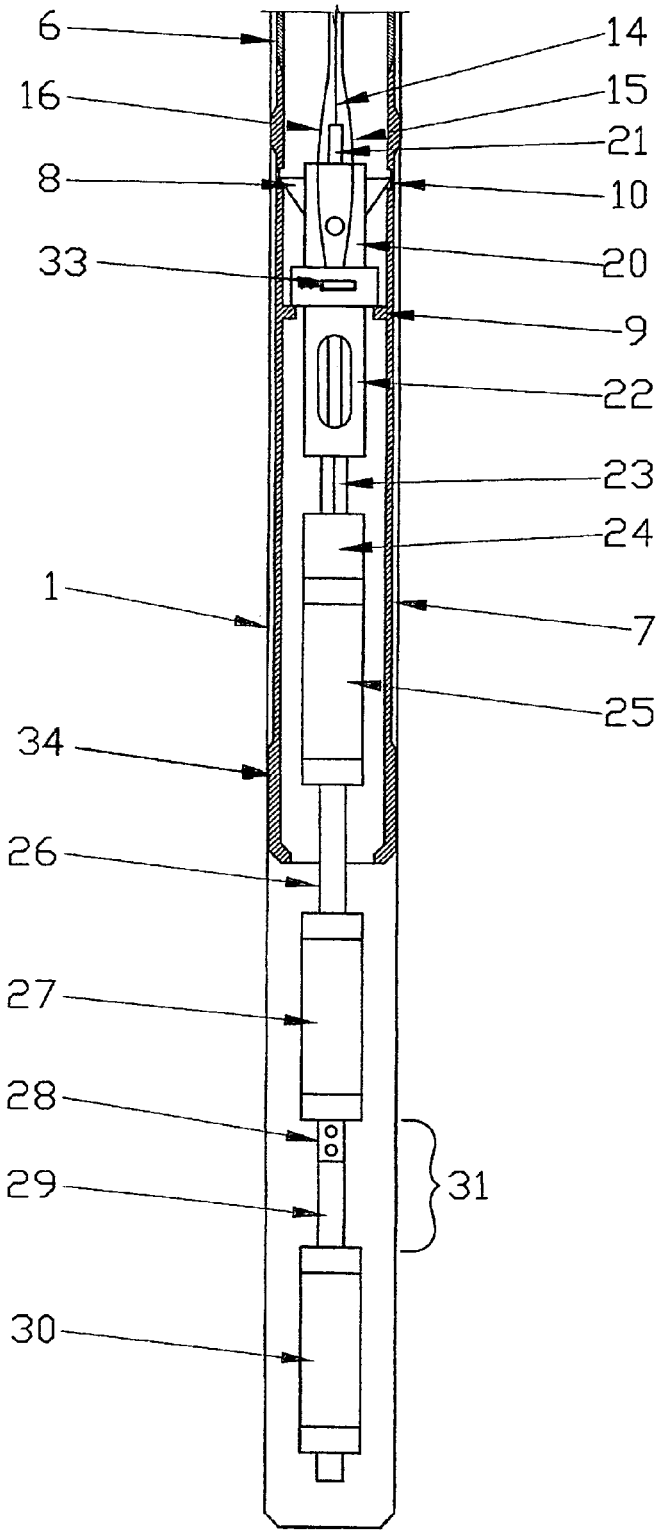
FIG. 1 is a side exposed view of the downhole components according to one embodiment of the invention.

FIG. 1 illustrates one embodiment of the downhole tool employed in the straddle form, located in the outer core barrel of the type similar to that produced by Boart Longyear, and at the end of a drill string. Here, a borehole (1) has been drilled using a core bit (34). Within the borehole (1) is an outer core barrel (7) with a landing ring (9). Above the outer core barrel (7) is a portion of the drill string (6).

The downhole tool shown in this embodiment comprises a latch assembly (20) which rests on the landing ring (9). The latch assembly (20) includes latches (8) which lock into an annular latching groove (10) of the core barrel (7). It should be understood that this mode of latching comports with the Boart Longyear wireline retrievable core barrel system. However, alternative latching arrangements can be used with other types of wireline coring systems where the latching system may vary from that shown. Above the latch assembly (20) is a connector (21) by which the wireline (14) is connected to the latch assembly (20). The connector (21) includes a shear pin so that in the event of the tool being jammed and unable to be retrieved through the core bit, the wireline (14) can be pulled away from the latch assembly (20), bringing with it the inflation tube (15) and communication cable (16).

Located below the latch assembly (20 is a latch body connector (22) which connects the latch assembly (20) to a transducer and electronics housing (23). Within the latch body connector (22) connections exist between the electronics housing (23), the communication cable (16), the inflation tube (15), and the packer inflation tube (not shown). The transducer and electronics housing (23) contains three pressure transducers (not shown) and the electronics (not shown) to both store information and send information to the surface via the communications cable (16). The three pressure transducers in the transducer and electronics housing (23) measure the pressure in the test zone (31), the pressure in the packers (25, 27, 30) and the pressure in the drill string (6) at the level of the transducer and electronics housing (23).

Located below the transducer and electronics housing (23) is a main valve (24) which is situated above the valve packer (25). Located below the valve packer (25) is a connecting tube (26), within which there is an inflation tube (not shown) which connects the valve packer (25) to the top packer (27). Below the top packer (27) is a ported section (28) which permits fluids to pass between the test zone (31) through a mandrel of the top packer (27), the connecting tube (26), a mandrel of the valve packer (25) to the main valve (24) and out into the drill string (6) through the top of the main valve (24). The extension tubes (29), of the ported section (28) can be attached to the bottom packer (30). The test zone (31) is located between the top packer (27) and the bottom packer (30). Inflation fluid is conveyed from the top packer (27) in a tube inside the ported section (28) to the extension tube (29) which is filled with the inflation fluid (preferably a liquid).

The packers (25, 27, 30) are inflated via the inflation tube (15), using either a compressed gas, or preferably a liquid. If compressed gas is used for inflation, then deflation is achieved by releasing the gas at the surface. The wireline (14) can then be pulled, which causes the latches (8) in the latch assembly (20) to pull out of the locking groove (10), thus releasing and enabling the entire downhole assembly to be pulled to the surface. If an inflation liquid is used, it is necessary to release the fluid pressure downhole to ensure deflation. This is achieved by incorporating a dump valve (33) into the latch assembly (20). To deflate the tool, the wireline (14) is pulled, which causes the dump valve to open and deflate the packers (25, 27, 30). Either simultaneously or once deflation has occurred and the latches (8) in the latch assembly (20) are pulled out of the locking groove (10), the downhole tool can be retrieved.

As described above, the tool can be used in a configuration to straddle a test zone (31), with a top packer (27) and a bottom packer (30). it is also possible to use the tool in a bottom test configuration. In this case, the bottom packer (30) and extension tube (29) is not used and a sealing cap (not shown) is placed over the bottom of the ported section (28) to contain the packer inflation fluid.

The main valve (24) is operated by axial movement. The axial movement is achieved by raising and lowering the drill string (6) while the packers (25, 27, 30) are inflated so that the outer section of the main valve (24) is held within the outer core barrel (7) by the valve packer (25), while the inner section of the main valve (24) which is attached to the mandrel of the top packer (27), is locked to the borehole (1) wall by inflation. In operation of the main valve (24), lowering of the drill string (6) causes the valve packer (25) to slide over its mandrel, which is locked by the top packer (27) to the borehole (1) wall. This sliding leads to the closure of the main valve (24). Raising of the drill string (6) causes the main valve (24) to open.

While not shown in detail, the main valve (24) is preferably a device which causes zero volume change in the area below it when it is opened or closed, and thus does not affect the test volume. The main valve (24) should have a minimal tendency to open or close under the influence of changing pressure above or below it. The structure and operation of the main valve (24) is described in more detail below with FIGS. 4-6.

There is a passage for fluid flow through the drill string (6), the outer core barrel (7), and the core bit (not shown), with all the components of the downhole tool (represented by all items between and inclusive of 20 and 30) in place when the valve packer (25) is not inflated. Thus, circulation of drilling mud may be achieved with the downhole tool in this state. This is of great benefit in the control of blowout situations. When the valve packer (25) is inflated, a passage for fluid within the outer core barrel (7) still exists above the valve packer (25) and within the drill string (6). The passage of fluid through the main valve (24) is controlled by that valve and the relative location of the outer core barrel (7) to the top packer (27), which is achieved by raising or lowering the drill string (6).

Figure 2:
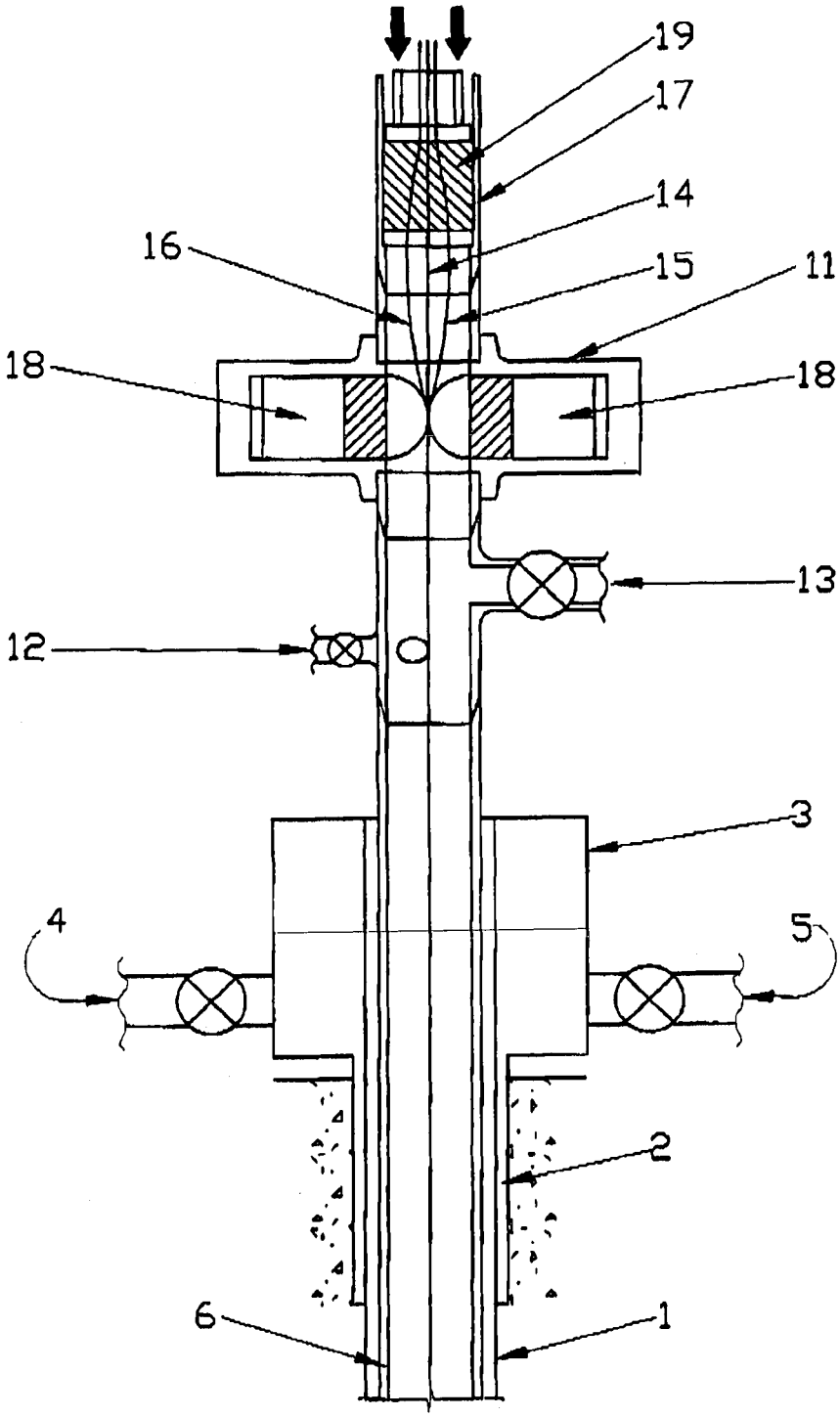
FIG. 2 is a side exposed view of the uphole components according to one embodiment of the invention.

FIG. 2 illustrates a typical embodiment of the components at the top of the borehole. At the top of the borehole is a surface casing (2) which is cemented in place. Attached to the top of the surface casing (2) is a blowout preventer (3), shown here without detail in an annular form and with valve controlled ports (4) and (5) below it.

At the top of the drill string (6) is a snubber (11) with valve controlled ports (12) and (13) below it. The snubber (11) is configured to be able to be closed around the wireline (14), inflation tube (15) and the communication cable (16), in the event of a blowout if the top seal (17) is not in place, such as during raising or lowering of the tool. Above the snubber (11), the top seal (17) seals the wireline (14), inflation tube (15) and the communication cable (16) into the top of the drill string (6). The snubber (11) can be an elastomeric faced ram (18) with hydraulics (not shown) used to load the rams (18). The top seal (17) employs an elastomeric seal (19) actuated by a vertical load.

It should be noted that the port (12) connects to the drill string (6) tangentially so as to permit the injection of a liquid into the drill string (6) while avoiding blocks with escaping gas. The port (13) functions as a gas vent during filling of the drill string (6).

FIGS. 3A-3F are simplified schematic diagrams which illustrate the operation of an embodiment of the invention in performing a single DST.

Figure 3:
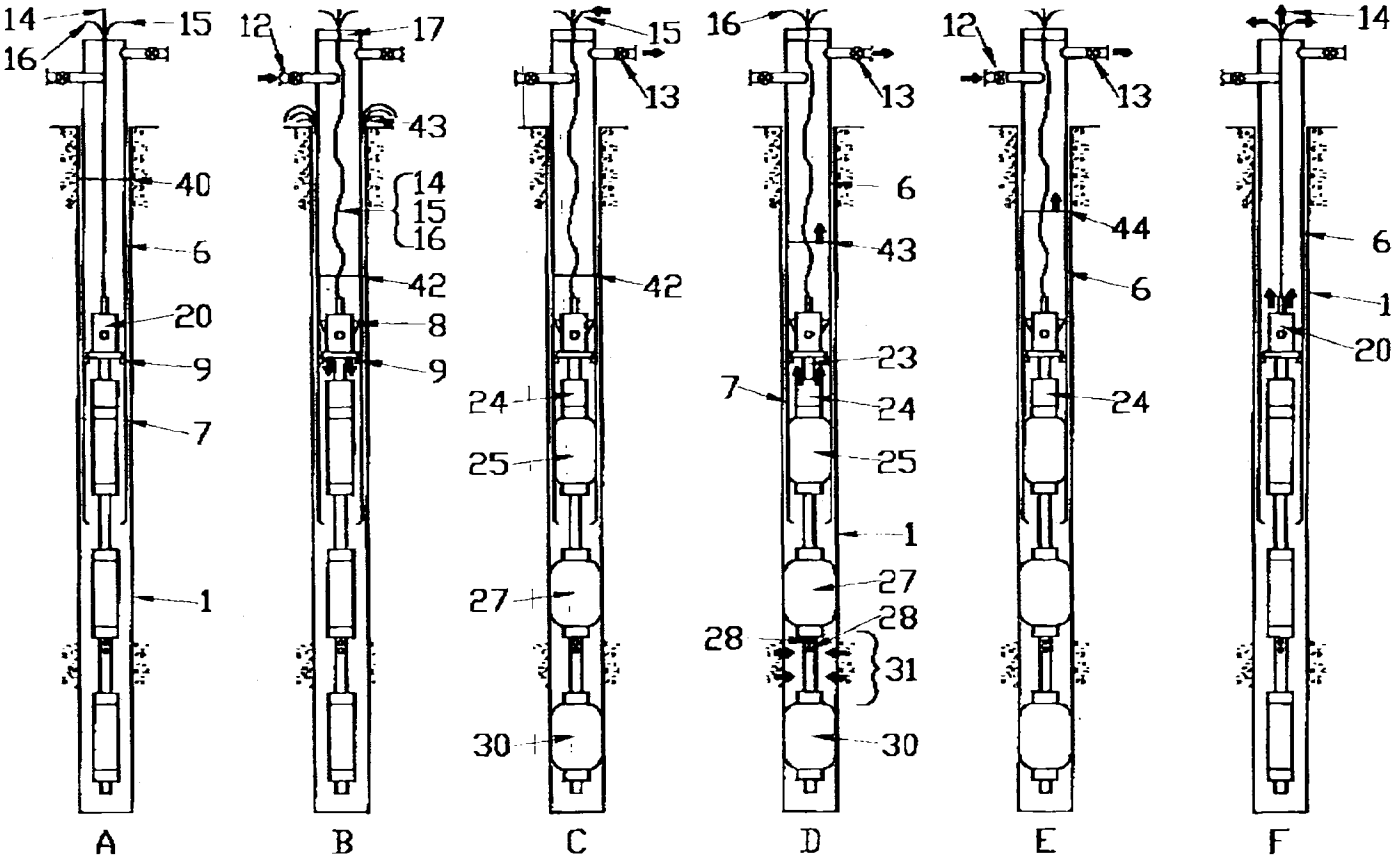
FIGS. 3A-3F are respective side views illustrating the stages of operation of an embodiment of the invention in performing DST. In these drawings, the uphole tools are simplified by the omission of the blow out preventer and snubber.

In FIG. 3A, the downhole tool is suspended by a wireline (14) just before resting on the landing ring (9). At this stage, the latches (not shown) are withdrawn into the latch assembly (20). The well bore fluid level within the drill string (6) and in the borehole is shown at location (40).

In FIG. 3B, the downhole tool rests on the landing ring (9), with the top seal (17) in place to seal around the wireline (14), the inflation line (15) and communication cable (16), which are slack within the drill string (6). The latches (8) protrude out of the latch assembly (20) to lock the downhole tool in place in the locking groove (not shown). Compressed gas is delivered to port (12). As a result, the fluid level (42) within the drill string (6) is depressed and lowered, and as a consequence, drilling fluid overflows at the top of the hole (43). This process is undertaken to achieve a controlled depression of the fluid level (42) within the drill string (6).

In FIG. 3C, the packers (25, 27, 30) are inflated by fluid pressure applied to the inflation tube (15). The compressed gas is being released from port (13) and the main valve (24) is closed to prevent flow to or from the test zone (31) between the packers (27, 30).

In FIG. 3D, the drill string (6) has been raised while the valve packer (25) is fixed in the outer core barrel (7). The test zone packers (27 and 30) are locked in the borehole (1). The raising of the drill string (6) in this condition opens the main valve (24) and permits fluids to flow from the test zone (31) through the ports (28) and up through the tubes and packer mandrels to be released inside the outer core barrel (7) at the top outlet of the main valve (24). This release of fluid leads to a gas discharge at the port (13), and if a liquid is produced, the liquid level (43) raises in the drill string (6). This change of liquid level is detected by transducers and electronics within the housing (23) and transmitted to the surface via the communication cable (16). The volume of gas discharge at port (13) is measured by a flow meter (not shown). The net gas discharge is the total gas discharged minus the displaced volume between liquid levels (42 in FIG. 3C and 43 in FIG. 3D respectively).

In FIG. 3E, the main valve (24) has been closed by lowering the drill string (6) for recovery from the flow period. Shown here (though the processes can be advantageously separated in time) is the injection of a fluid into port (12) to fill the drill string (6). If, as in the preferred embodiment, the port (12) tangentially enters the drill string (6), then the swirling motion of the liquid means that it tends to remain on the inside of the drill string (6). This permits the escape of gas up the centre of the drill string (6) and out of the port (13), thus facilitating filling of the drill string (6). The liquid level is shown here at location (44).

In FIG. 3F, the drill string (6) and borehole (1) are filled to the top and the top seal (not shown) is removed. The wireline (14) is pulled taught so as to cause the dump valve, which is part of the latch assembly (20), to release fluid from the packers (25, 27, 30) to cause deflation thereof. The downhole tool is then pulled out of the drill string (6). The drill string (6) can then be reused at the next test location, whereupon the tool is lowered again and the test process is repeated.

Figure 4:
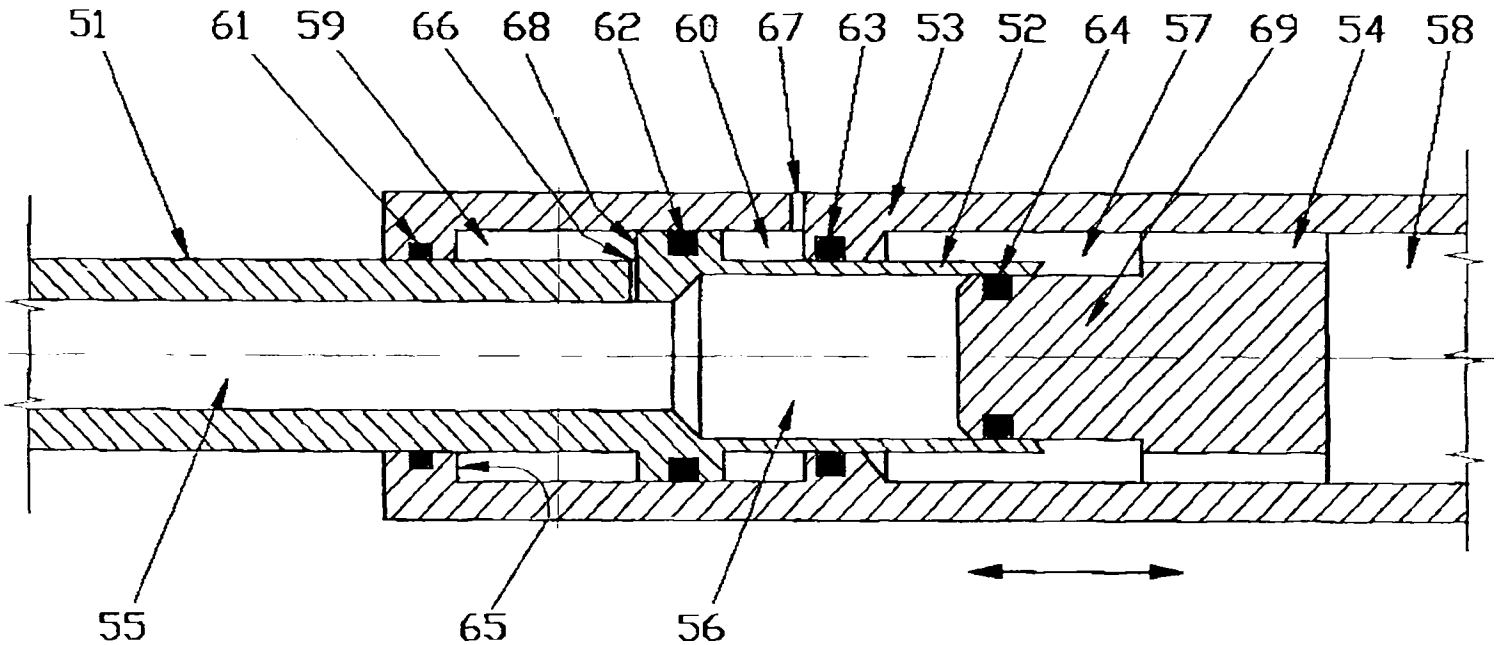
FIG. 4 illustrates the main valve of the tool in a position just after being closed.

FIG. 4 is a schematic representation of the main valve (24) shown closed, but not to the full range of movement. The pipe (51) of the main valve (24) is connected to the mandrel of the top packer. The pipe (51) is connected to an enlarged section which forms a piston (68) between chambers (59) and (60) in the valve body (53). The pipe (51) and piston (68) extend upwards into a sleeve (52) which slides over valve plug end (69). The plug end (69) is attached to the valve body (53), but is shown separated from it by the ports (54) which are preferably drilled in the plug end (69) between chambers (57) and (58). The valve body (53) is connected to the valve packer and drill string. An elastomeric seal (61) seals the lower pipe (51) into the valve body (53). Another elastomeric seal (62) seals the piston section (68) into the valve body (53), and yet another elastomeric seal (63) seals the sleeve (52) into the valve body (53). The sleeve (52) is shown engaged over the valve plug end (69) and sealed therein using an elastomeric seal (64). The plug end (69) is constructed to have a close fit in the sleeve (52) so as to substantially stop fluid flow before the elastomeric seal (64) enters the sleeve (52). The elastomeric seal (64) is constructed of a sufficiently rigid material that it will not be lifted out of its groove by fluid pressure during opening and closure of the main valve (24).

Port (67) formed in the main valve body (53) preferably connects the annulus between the tool and the borehole to a chamber (60). In an alternative embodiment, port (67) may be omitted or blocked, in which case chamber (60) is assembled with zero volume so as to create a vacuum within it when expanded. Chamber (59) has within it the same pressure as exists in the interior (55) of the pipe (51). The effect of the chamber (59) is to absorb the fluid that is displaced by the entry of the plug (69) in the sleeve (52) as the body (53) of the main valve (24) is lowered by moving the drill string downwards. This movement is transferred to the valve body (53) through the valve packer while the pipe (51) is locked in place by the top packer. Thus, there is no change of volume with valve closure or opening. To achieve this, the area of the annulus of the chamber (59) is the same as the area of the plug (69). The force exerted by downhole fluid pressure on the plug (69) is the same as that exerted on the face (65) of chamber (59) and thus the effects of changing pressures do not tend to move the valve body (53) with respect to the pipe (51). The main valve (24) therefore has no tendency to open or close with changing downhole pressures. The valve (24) is, however, not fully balanced with respect to uphole pressure. To minimise these effects, the sleeve (52) is made as thin as is consistent with its strength so as to reduce the area on which the pressure in chamber (57) acts. If the port (67) is not connected to the annulus of the borehole and the main valve (24) is assembled with zero volume in chamber (67), then there will be a tendency to close the valve (24). This is brought about by the effect of downhole pressure acting on the lower face of the piston (68). This can sometimes be used to advantage in that the tool tends to automatically close.

Figure 5:
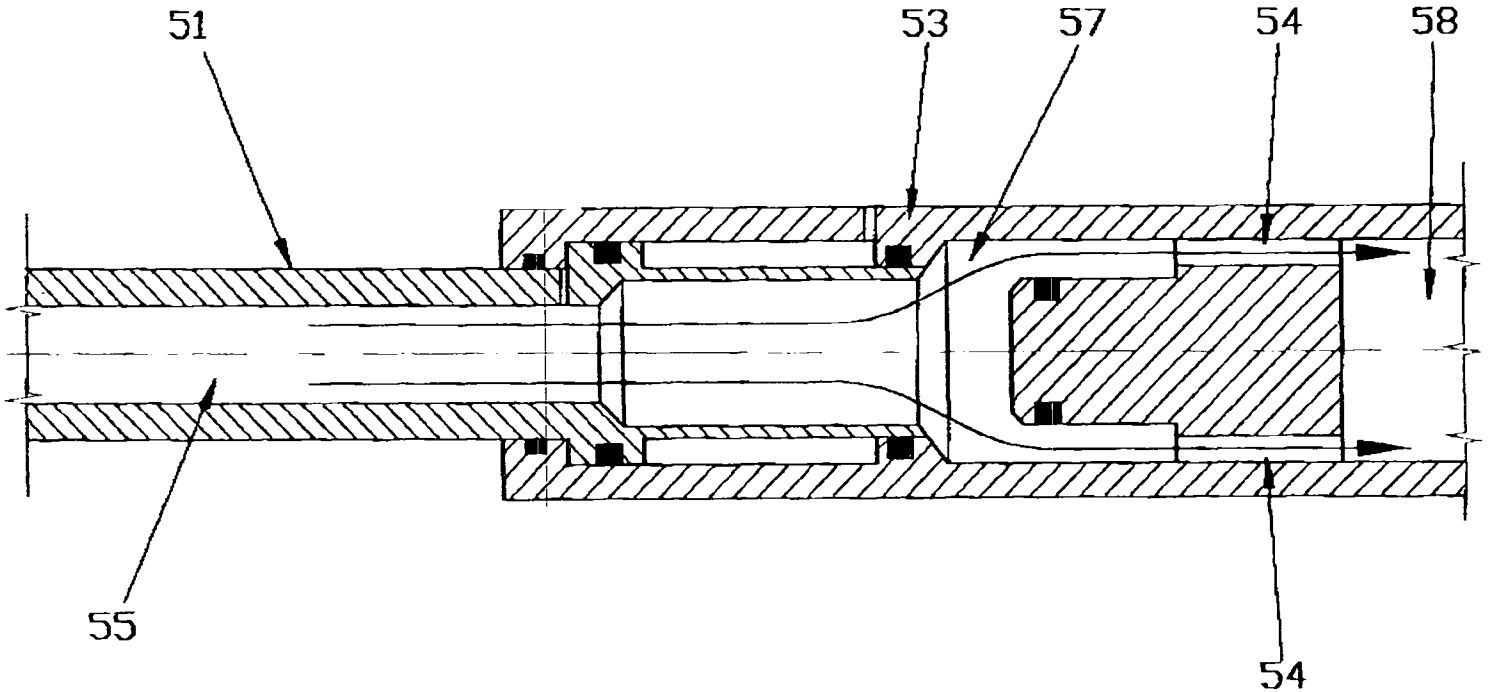
FIG. 5 illustrates the main valve in the open position.

FIG. 5 illustrates the main valve (24) in the open position with fluid flow from inside (55) the pipe (51) passing into chamber (57) and thence through ports (54) and out into the upper chamber (58) of the valve body (53).

Figure 6:
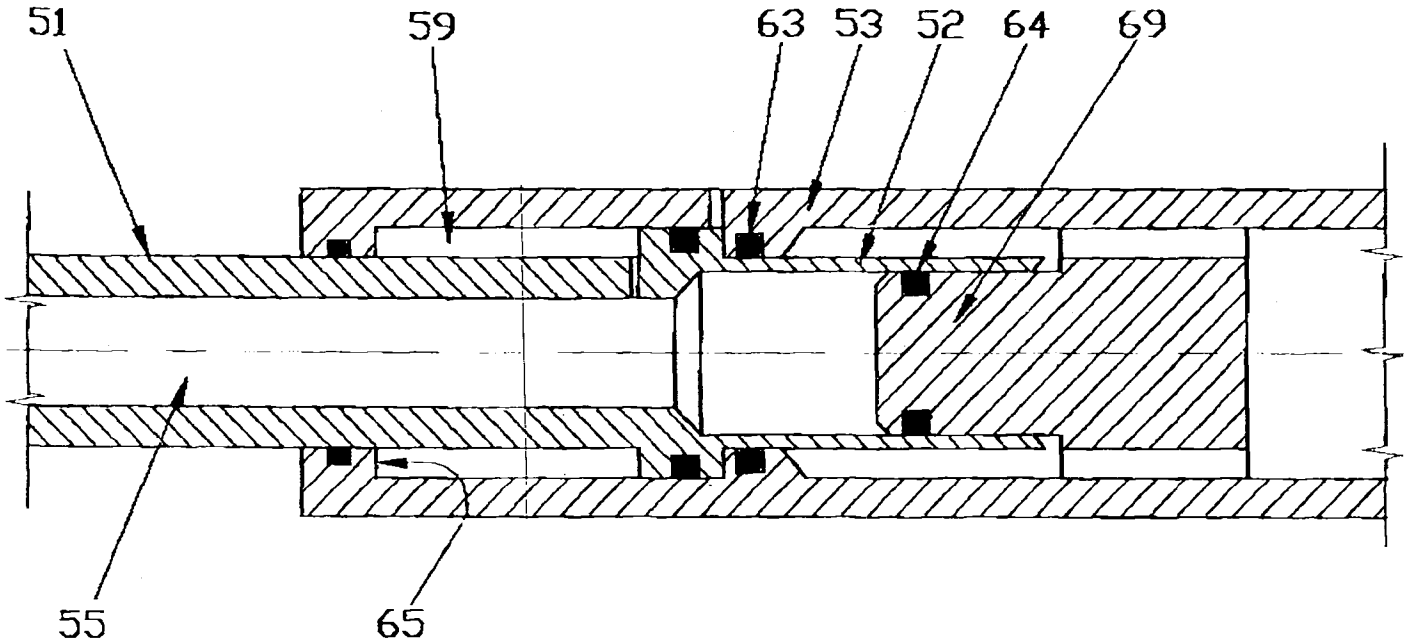
FIG. 6 illustrates the main valve in the closed position.

FIG. 6 shows the main valve (24) in the closed position. In this case, the plug (69), which is connected to the valve body (53), is fully inserted into the sleeve (52) and sealed therein by the seal (63). This valve (24) closure is achieved by the setting of the top packer so that pipe (51) is locked in place while the drill string is used to lower the valve body (53) to close the main valve (24). In this state, variations in pressure of the downhole pressure inside the pipe (55) are balanced by the action of the pressures on the plug (69) and the face (65) within the chamber (59).

While the preferred and other embodiments of the invention have been disclosed with reference to specific downhole tool parts and apparatus, it is to be understood that changes in detail may be made as a matter of engineering and design choices, without departing from the spirit and scope of the invention, as defined by the appended claims.

The invention claimed is:

1. A method of conducting a drill stem test of a geological test zone using a downhole tool that is run into a drill string to conduct the test, comprising:

utilising a wireline coring drill string system of the type employing a coring drill bit and a core barrel;

drilling a borehole using the coring drill bit, and then raising the coring drill bit to define a test zone in the borehole below the raised coring drill bit;

utilizing a first inflatable packer, a second inflatable packer and a valve as at least a part of the downhole tool;

conveying the downhole tool via a wireline system into the drill string;

lowering the downhole tool so that the first inflatable packer is placed at a location beyond a bottom of the coring drill bit, the first inflatable packer located so that it engages with and seals the borehole on one side of the test zone;

utilising the second inflatable packer to seal the downhole tool to the core barrel;

holding the valve in the core barrel by the second inflatable packer, and utilising the valve to control the passage therethrough of fluid flowing through the second inflatable packer;

moving the drill string to open and close the valve within the downhole tool to permit fluid flow to and from the test zone to the inside of the drill string; and analysing parameters of the gas and liquid obtained from the geological test zone.

2. The method of claim 1, further including raising and lowering the drill string to operate the valve.

3. The method of claim 1, further including unburdening the drill string of liquid, displacing a liquid level in the drill string by supplying a pressurised gas to the drill string, forcing the liquid past the downhole tool by deflating the second packer, sealing the downhole tool on inflation of the second packer within the drill string to thereby maintain a depressed state of the liquid level within the drill string, and venting gas from the drill string.

4. The method of claim 1, further including inflating the first and second inflatable packers by pressurising a fluid conveyed by a separate tube run within the drill string.

5. The method of any one of claims 1 to 4, further including inducing fluid flow in a drill string test by raising the drill string following inflation of the first and second inflatable packers to open the valve which permits flow from the test zone to the drill stem.

6. The method of claim 5, further including stopping fluid flow, and inducing a pressure build up following a flow period by lowering the drill string to shut the valve.

7. The method of claim 6, wherein said first and second inflatable packers are deflated by pulling on the wireline, and a latch between the downhole tool and the core barrel is released by pulling on the wireline.

8. The method of claim 5, wherein said first and second inflatable packers are deflated by pulling on the wireline, and a latch between the downhole tool and the core barrel is released by pulling on the wireline.

9. The method of claims 1 to 4, further including deflating the first and second inflatable packers by pulling on the wireline to open a dump valve within the downhole tool and vent the fluid that inflates the first and second inflatable packers into the drill string.

10. The method of claim 9, further including latching the downhole tool to an outer tube of the core barrel, and said downhole tool remains latched until the wireline is pulled to release the latched condition.

11. The method of any one of claims 1 to 4 and 6, further including latching the downhole tool to an outer tube of the core barrel, and said downhole tool remains latched until the wireline is pulled to release the latched condition.

12. A method of conducting a drill stem test of a geological test zone, comprising:

lowering a drill string and attached core barrel into a borehole;

attaching a downhole tool at a desired location within the core barrel using a wireline connected to a latch mechanism, said downhole tool including said latch mechanism, a main valve to control fluid flow through the core barrel, a valve packer located in said core barrel, and one or more packers located in the borehole and below said valve packer for isolating the geological test zone in the borehole;

pressurising the drill string with a gas to lower a borehole fluid level in the borehole, and then closing the main valve;

inflating the valve packer to seal within the core barrel and inflating the one or more packers to seal the one or more packers against the borehole;

releasing the pressurised gas in the drill string;

raising the drill string to open the main valve so that fluid from the geological test zone flows through the downhole tool upwardly into the drill string;

measuring parameters of the gas and liquid from the drill string to analyse the geological test zone;

lowering the drill string to close the main valve and venting any pressurised gas in the drill string, and then filling the drill string with a liquid; and pulling the wireline to deflate the valve packer and the one or more packers, and removing the downhole tool from the drill string and the core barrel.

13. The method of claim 12, further including using two of the one or more packers to straddle the geological test zone.

14. The method of claim 12, further including using one of the one or more packers to seal the well bore above the geological test zone.

15. The method of claim 12, further including connecting a valved pipe of the main valve to a hollow mandrel of the valve packer, and connecting the hollow mandrel of the valve packer to a hollow mandrel of the packer located below the valve packer.

16. The method of claim 12, further including using a plunger valve in the main valve, where the plunger valve moves in a reciprocating manner to open and close in response to the raising and lowering of the drill string.

17. The method of claim 16, further including moving the plunger valve in the main valve without disturbing the fluid pressure in the geological test zone.

18. A method of conducting a drill stein test of a geological test zone, comprising:

using a coring drill system to drill a borehole;

lowering a drill string and a core barrel attached thereto into the borehole, said core barrel having a downhole tool therein, the downhole tool connected to a wireline;

using a latch to lock the downhole tool in the core barrel;

sealing a top of the drill string and pressurising the drill string with a gas to displace fluid from the drill string up an annulus between the drill string and the borehole;

inflating one or two packers to seal against the formation and isolate a test zone in the borehole;

inflating a valve packer to fix a main valve to the inner surface of said core barrel, said main valve having an axially movable part, movable in response to axial movement of the drill string to open and close a valve in the main valve to open and close a hollow pipe in the main valve;

axially moving the drill string downwardly to close the main valve;

venting the drill string above the main valve to reduce the pressure therein;

waiting for stabilization of the pressure in the test zone;

raising the drill string to open the main valve and allow the fluid from the test zone to flow through the downhole tool and allow parameters thereof to be measured by downhole transducers and transmitting corresponding data to surface equipment;

preventing the movement of the axially movable part of the main valve from disturbing fluid pressure in the geological test zone;

pulling on the wireline to release attachment of the downhole tool in the core barrel; and pulling the wireline to remove the downhole tool from the core barrel.

19. The method of claim 18, further including using a pair of packers attached to the downhole tool for isolating the geological test zone.

* * * * *